US006129161A

United States Patent [19]

Roberts et al.

[11] Patent Number: 6,129,161

[45] Date of Patent: Oct. 10, 2000

[54] ROTARY DRILL BITS WITH EXTENDED BEARING SURFACES

[75] Inventors: Tom Scott Roberts, Abbeymead; Clive Jarvis, Swindon, both of United Kingdom

[73] Assignee: Camco International (UK) Limited, Stonehouse, United Kingdom

[21] Appl. No.: 09/159,715

[22] Filed: Sep. 24, 1998

[30] Foreign Application Priority Data

Jul. 22, 1998 [GB] United Kingdom ..... 9815843

[51] Int. Cl.[7] ..... E21B 10/60

[52] U.S. Cl. ..... 175/393

[58] Field of Search ..... 175/393, 424, 175/327, 339, 340

[56] References Cited

U.S. PATENT DOCUMENTS 5,794,725 8/1998 Trujillo et al. ..... 175/393 X
5,819,860 10/1998 Newton et al. ..... 175/393
5,967,246 10/1999 Caraway et al. ..... 175/393

FOREIGN PATENT DOCUMENTS 2 294 070 4/1996 United Kingdom .

*Primary Examiner*—David Bagnell
*Assistant Examiner*—Kamal Dawelbeit
*Attorney, Agent, or Firm*—Jeffrey E. Daly

[57] ABSTRACT

A rotary drill bit comprises a bit body having a leading face and a gauge region, cutting elements mounted on the bit body, fluid channels extending outwardly across the leading face towards the gauge region, and nozzles for supplying fluid to the channels. At the outer end of each alternate channel, in the gauge region, is an outwardly facing junk slot which extends across only a part of the width of the channel, and a bearing surface which extends across the other part of the channel and bears against a wall of the borehole being drilled. In the channel, inwardly of the bearing surface, is an opening into an enclosed passage which passes internally through the bit body to an outlet. The bearing surfaces at the end of the channels increase the peripheral bearing surface area of the drill bit, thus improving stability, but fluid can still escape from all parts of each channel.

27 Claims, 3 Drawing Sheets

ROTARY DRILL BITS WITH EXTENDED BEARING SURFACES

BACKGROUND OF THE INVENTION

1. Field of the Invention

The invention relates to drag-type rotary drill bits for use in drilling holes in subsurface formations and of the kind comprising a bit body having a leading face and a gauge region, a plurality of cutting elements mounted on the bit body, a plurality of fluid channels extending outwardly away from the bit axis across said leading face and towards the gauge region and a plurality of nozzles for supplying fluid to the channels.

2. Description of Related Art

The invention is particularly, but not exclusively, applicable to drill bits in which some or all of the cutting elements are preform (PDC) cutters each formed, at least in part, from polycrystalline diamond. One common form of cutter comprises a tablet, usually circular or part-circular, made up of a superhard table of polycrystalline diamond, providing the front cutting face of the element, bonded to a less hard substrate which is usually of cemented tungsten carbide.

The bit body may be machined from solid metal, usually steel, or may be molded using a powder metallurgy process in which tungsten carbide powder is infiltrated with metal alloy binder in a furnace so as to form a hard matrix.

In the normal prior art construction the gauge region of the drill bit is formed by a plurality of kickers which are spaced apart around the outer periphery of the bit body and are formed with bearing surfaces which, in use, bear against the wall of the borehole. The kickers generally form continuations of respective blades formed on the leading face of the bit and extending outwardly away from the axis of the bit towards the gauge region so as to define said fluid channels between the blades. The spaces between the kickers define junk slots with which the channels communicate. During drilling, drilling fluid pumped down the drill string to the nozzles in the bit body flows outwardly along the channels, into the junk slots at the ends of the channels, and passes upwardly through the junk slots into the annulus between the drill string and the wall of the borehole.

While PDC bits have been very successful in drilling relatively soft formations, they have been less successful in drilling harder formations, including soft formations which include harder occlusions or stringers. Although good rates of penetration are possible in harder formations, the cutters may suffer accelerated wear and the bit life may be too short to be commercially acceptable.

Studies have suggested that the rapid wear of PDC bits in harder formations may be due to chipping of the cutters as a result of impact loads caused by vibration of the drill bit. One of the most harmful types of vibration can be attributed to a phenomenon called "bit whirl", in which the drill bit begins to precess around the hole in the opposite direction to the direction of rotation of the drill bit. One result of bit whirl is that some cutters may temporarily move in the reverse direction relative to the formation and this can result in damage to the cutters.

It is believed that the stability of such a drill bit, and its ability to resist vibration, may be enhanced by increasing the area of the bearing surfaces on the gauge region which engage the wall of the borehole. In most prior art designs, however, the area of engagement could only be increased by increasing the length and/or width of the bearing surfaces of the kickers. It may be undesirable to increase the length of the bearing surfaces since this may lead to difficulties in steering the bit in steerable drilling systems. Similarly, increasing the circumferential width of the bearing surfaces necessarily reduces the width of the junk slots between the bearing surfaces, and this may lead to less than optimum hydraulic flow of drilling fluid along the channels and over the cutters, or it may lead to blockage of the junk slots and channels by debris.

British Patent Specification No. 2294070 describes and claims certain arrangements for reducing or overcoming some of the above disadvantages. The specification describes a drill bit of the kind first referred to wherein there is provided at the outer end of at least one of the channels, in the gauge region, an additional bearing surface which extends across the whole width of the channel. The bearing surface necessarily inhibits flow of drilling fluid from the channel across the gauge region of the drill bit. In order to allow escape of drilling fluid flowing outwardly along the channel, therefore, there is provided in the channel, adjacent the gauge region, an opening into an enclosed passage which passes internally through the bit body to an outlet. The present invention provides a development of the invention described in GB 2294070.

SUMMARY OF THE INVENTION

According to the invention there is provided a rotary drill bit comprising a bit body having a leading face and a gauge region, a plurality of cutting elements mounted on the bit body, a plurality of fluid channels extending outwardly away from the bit axis across said leading face and towards the gauge region, and a plurality of nozzles for supplying fluid to said channels, there being provided at the outer end of at least one of said channels, in the gauge region, an outwardly facing junk slot which extends across only a part of the width of the channel, and a bearing surface which also extends across only a part of the channel and which, in use, bears against a wall of the borehole being drilled, there being provided in said channel, inwardly of the gauge region, an opening into an enclosed passage which passes internally through the bit body to an outlet.

The provision of a bearing surface which extends across part of the width of the channel increases the peripheral bearing surface area of the gauge region when compared with drill bits where the channel leads to a junk slot which extends across substantially the whole width of the channel. At the same time, however, the provision in the same channel of a junk slot which extends across part of the width of the channel ensures that fluid can still escape from the channel, across the gauge region, in the event that flow of fluid through the internal passage leading from the channel becomes restricted or prevented due, for example, to the accumulation of drilling debris in the passage or partial or complete blockage of the passage for any other reason.

The opening into the internal passage is preferably located in a part of the channel leading to said bearing surface. The opening may be located at the outer end of the channel, adjacent the bearing surface.

The outlet from the internal passage may communicate with the annulus between the drill string and the wall of the borehole being drilled.

The bearing surface may comprise the outer surface of a wall which extends partly across the outer end of the channel, said internal passage extending from said opening on one side of the wall to said outlet on the opposite side of the wall. The internal passage may then extend in generally the same direction as the junk slot.

In a preferred arrangement there is provided a single junk slot located at one side of the outer end of the channel, and adjacent a single bearing surface located at the other side of the outer end of the channel. However, arrangements are possible where there are provided more than one junk slot and/or more than one bearing surface at the outer end of the channel. For example, there may extend across the outer end of the channel a single junk slot between two spaced bearing surfaces, or a single bearing surface between two spaced junk slots.

In arrangements according to the invention, the junk slot is preferably located adjacent the trailing side of the channel with respect to the normal direction of rotation of the drill bit. The major flow of fluid outwardly along the channel will normally be in this region, since it will be adjacent the leading edge of the blade along which the cutters are mounted.

All of the channels in the leading face of the drill bit may have at their respective outer ends the combination of a junk slot and a bearing surface in accordance with the invention, or only some of the channels may have such combination. For example, the combination of junk slot and bearing surface may be provided at the outer ends of alternate channels around the circumference of the bit body.

Those channels which are not provided with the combination of a junk slot and a bearing surface at the outer end thereof may be provided with either a junk slot or a bearing surface which extends across substantially the whole width of the outer end of the channel.

In the case where at least one of the channels has a bearing surface extending across substantially the whole width of the outer end thereof, there is preferably provided in said channel, inwardly of the gauge region, an opening into an enclosed passage which passes internally through the bit body to an outlet.

In any of the above arrangements said channels may be defined between a plurality of blades formed on the leading face of the bit and extending outwardly away from the axis of the bit towards the gauge region. Said cutting elements may be mounted along said blades. There is preferably provided at the outer end of each blade, in the gauge region, a kicker having a bearing surface which, in use, bears against the wall of the borehole being drilled.

In any of the above arrangements there may be provided a nozzle in said internal passage. The nozzle may be directed towards said opening, so as to deliver fluid into the channel in which the opening is formed, or may be directed towards said outlet. In either case, the flow of fluid from the nozzle will assist in keeping the internal passage clear and preventing blockage thereof.

DETAILED DESCRIPTION OF THE PREFERRED EMBODIMENTS

Figure 1:
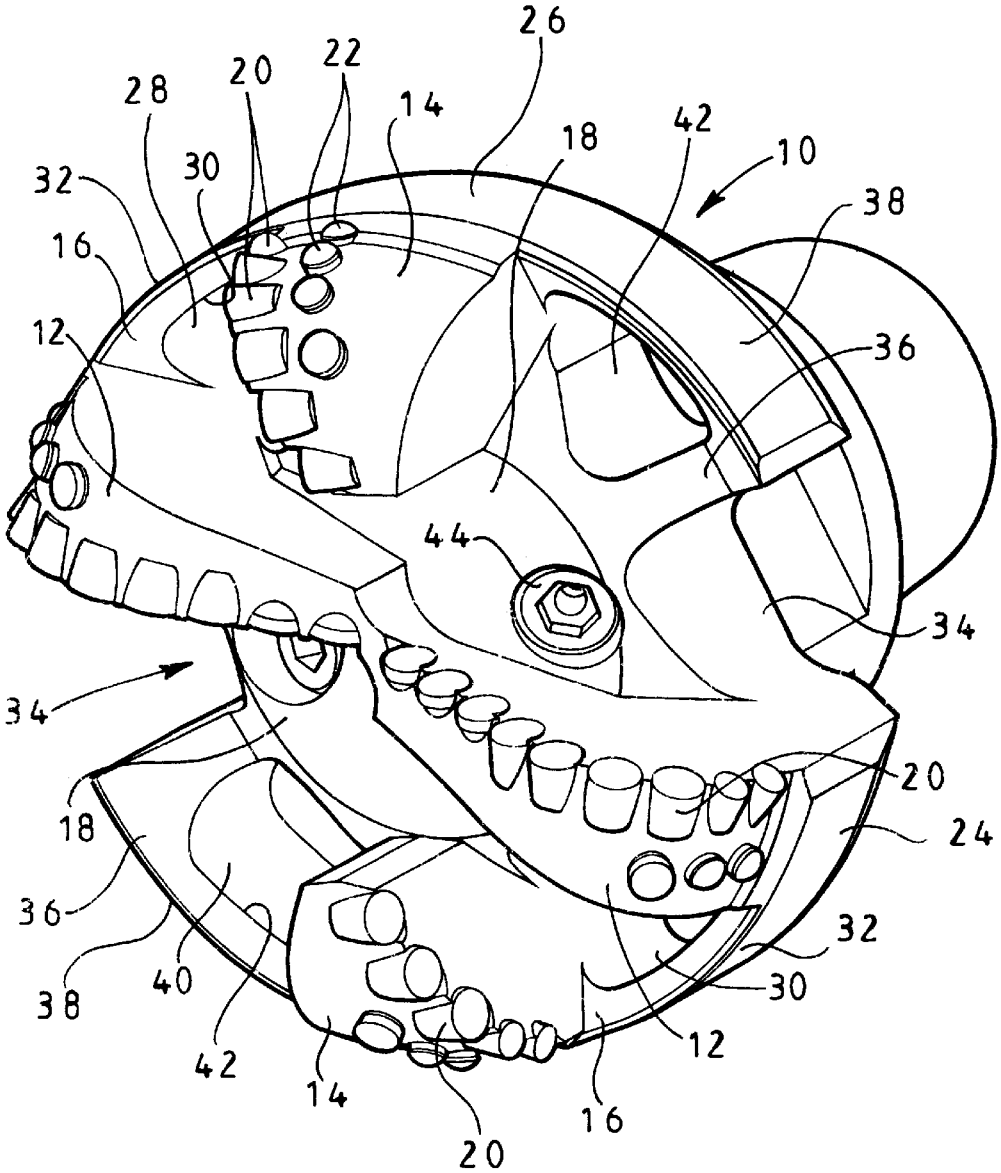
FIG. 1 is a perspective view of a PDC drill bit in accordance with the present invention.
Figure 2:
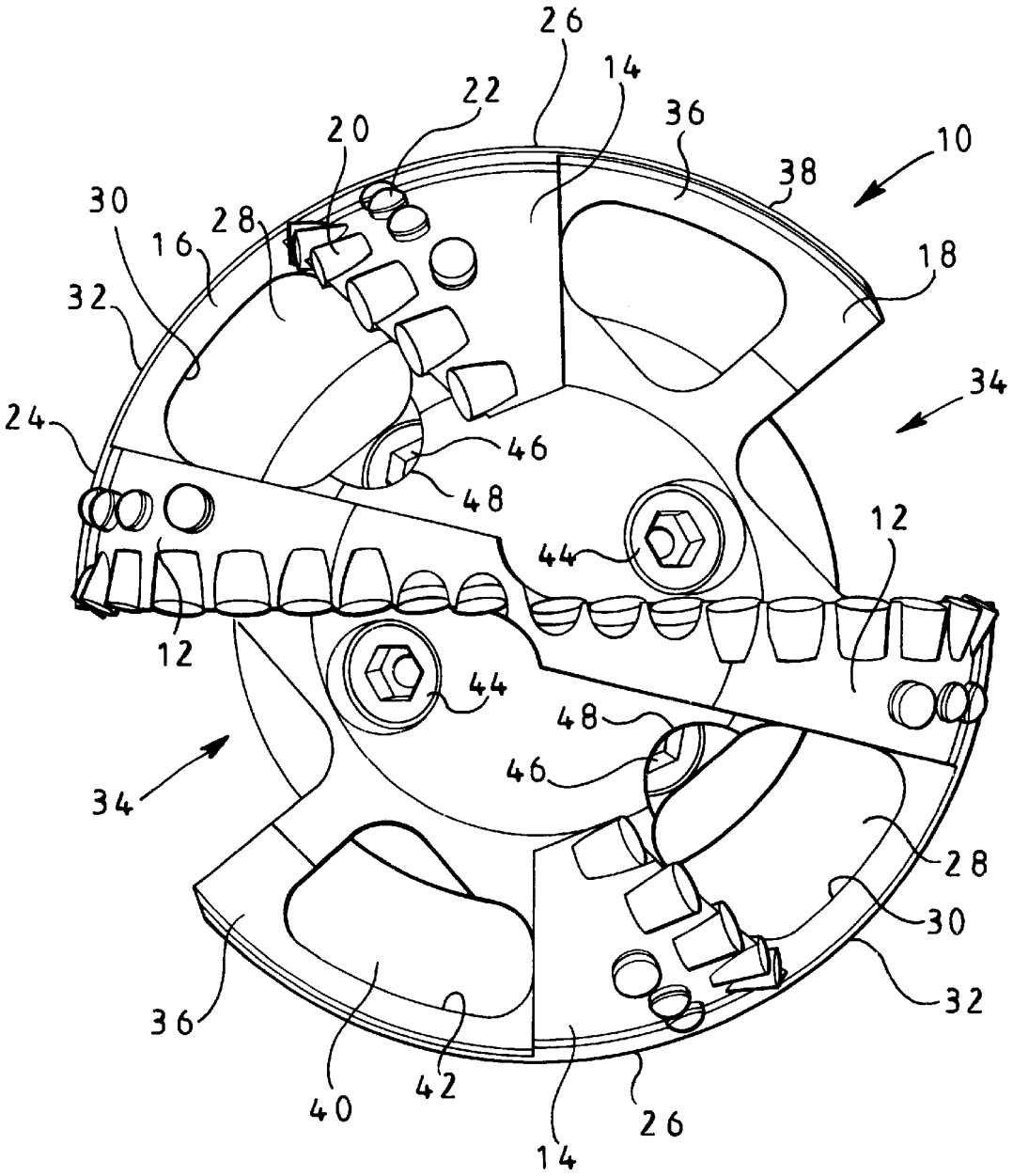
FIG. 2 is an end view of the drill bit shown in FIG. 1.

Referring to FIGS. 1 and 2: the drill bit comprises a bit body 10 having four blades formed on the leading face of the bit body and extending outwardly from the axis of the bit body towards the gauge region, the blades comprising two longer blades 12 and two shorter blades 14. Between adjacent blades there are defined channels 16, 18, the channels 18 on the leading sides of the blades 12 being of significantly greater angular extent than the channels 16 on the leading side of the shorter blades 14.

Extending side-by-side along each of the blades 12, 14 are a plurality of cutting structures, indicated at 20. The precise nature of the cutting structures does not form a part of the present invention and they may be of any appropriate type. For example, as shown, they may comprise circular preform cutting elements brazed to cylindrical carriers which are embedded or otherwise mounted in the blades, 12, 14. The cutting elements may each comprise a preformed compact having a polycrystalline diamond front cutting layer bonded to a tungsten carbide substrate, the compact being brazed to a cylindrical tungsten carbide carrier. In another form of cutting structure the substrate of the preformed compact is of sufficient axial length to be mounted directly in the blade, the additional carrier then being omitted.

Back-up abrasion elements or cutters may be spaced rearwardly of the outermost cutting structures, as indicated at 22.

The outer extremities of the blades 12, 14 are formed with axially extending kickers 24, 26 respectively, which provide part-cylindrical bearing surfaces which, in use, bear against the surrounding wall of the borehole and stabilize the bit in the borehole. Abrasion-resistant bearing elements (not shown) of any suitable known form are embedded in the bearing surfaces.

Formed in each of the narrower channels 16 adjacent the gauge region is an opening 28 into an enclosed internal passage 30 which extends generally axially through the bit body to an outlet (not shown) which communicates with the annulus between the drill string and the wall of the borehole being drilled.

The bearing surfaces 24 and 26 at the outer extremities of the blades 12 and 14 are connected by an intermediate part-cylindrical bearing surface 32 which extends across the entire width of the outer end of each channel 16 so as to form, with the bearing surfaces 24 and 26, a large continuous part-cylindrical bearing surface. This arrangement is in accordance with the teaching of the aforementioned British Patent Specification No. 2294070.

In accordance with the present invention, however, the configuration at the outer end of each of the wider channels 18 is different. According to the invention there is provided at the outer end of each of the channels 18 an outwardly facing junk slot 34 which is located at one side of the outer end of the channel, on the leading side of the longer blade 12, and extends across only a part of the width of the channel 18. In the illustrated arrangement the junk slot extends approximately half-way across the channel. Each junk slot 34 extends axially across the gauge region of the drill bit and operates in a similar fashion to a conventional junk slot, conducting fluid from the channel 18 upwardly to the annulus.

Extending across the other half of the outer part of each channel 18 is a wall portion 36 formed on its outer surface with a part-cylindrical bearing surface 38 which forms a continuation of the bearing surface 26 on the kicker associated with the adjacent blade 14.

An opening 40 is formed in one surface of the wall 36 and leads into an internal passage 42 which extends generally axially of the drill bit to an outlet (not shown) which communicates with the annulus between the drill string and the wall of the borehole.

The provision of the additional bearing surfaces 38 on the walls 36 increases the overall gauge bearing surface area of the drill bit and thus enhances the stability of the bit in use, and its resistance to vibration. Fluid flowing outwardly along each of the channels 18 is passed to the annulus by passing upwardly either through the junk slot 34 or through the internal passage 42.

Nozzles 44 are provided in the channels 18 and are directed to deliver drilling fluid outwardly along the leading edges of the longer blades 12 so as to cool and clean the cutters 20 mounted along each said blade.

In the narrower channels 16 nozzles 46 are mounted in recesses 48 adjacent the openings 28 into the internal passages 30. The nozzles 44 and 46 are connected via internal passages in the drill bit to a central axial passage through which drilling fluid is delivered from the drill string.

In use, while drilling, the majority of drilling fluid flowing outwardly from the nozzles 44 will pass upwardly through the junk slots 34 to the annulus. The smaller area internal passage 42, being further away from the nozzle 44, and being out of alignment with the direct flow of fluid from the nozzle, will be adequate to accommodate fluid flowing outwardly along the channel 18 towards the bearing surface 38.

In a modification of the arrangement shown in FIGS. 1 and 2, the narrower channels 16 may lead to conventional junk slots at the gauge, instead of to the bearing surfaces 32 and openings 30. However, it will be appreciated that this will reduce the overall bearing surface area of the gauge and the illustrated arrangement is preferred.

The arrangement according to the invention is particularly suitable for use with drill bits having a comparatively small number of blades, where there is a large angular distance between adjacent blades. In prior art arrangements where bearing surfaces were provided only on the kickers at the ends of the blades, bits having few blades tend to be unstable since the bearing surfaces are widely spaced and form only a small proportion of the peripheral extent of the gauge region. The present arrangement, however, also overcomes the possible disadvantage of having the bearing surface extending across the whole width of the outer of the end of the channel where the whole of the outward flow along a wide channel has to pass through an internal passage in the bit body which might provide inadequate flow, particularly if the internal passage became restricted by debris.

Figure 3:
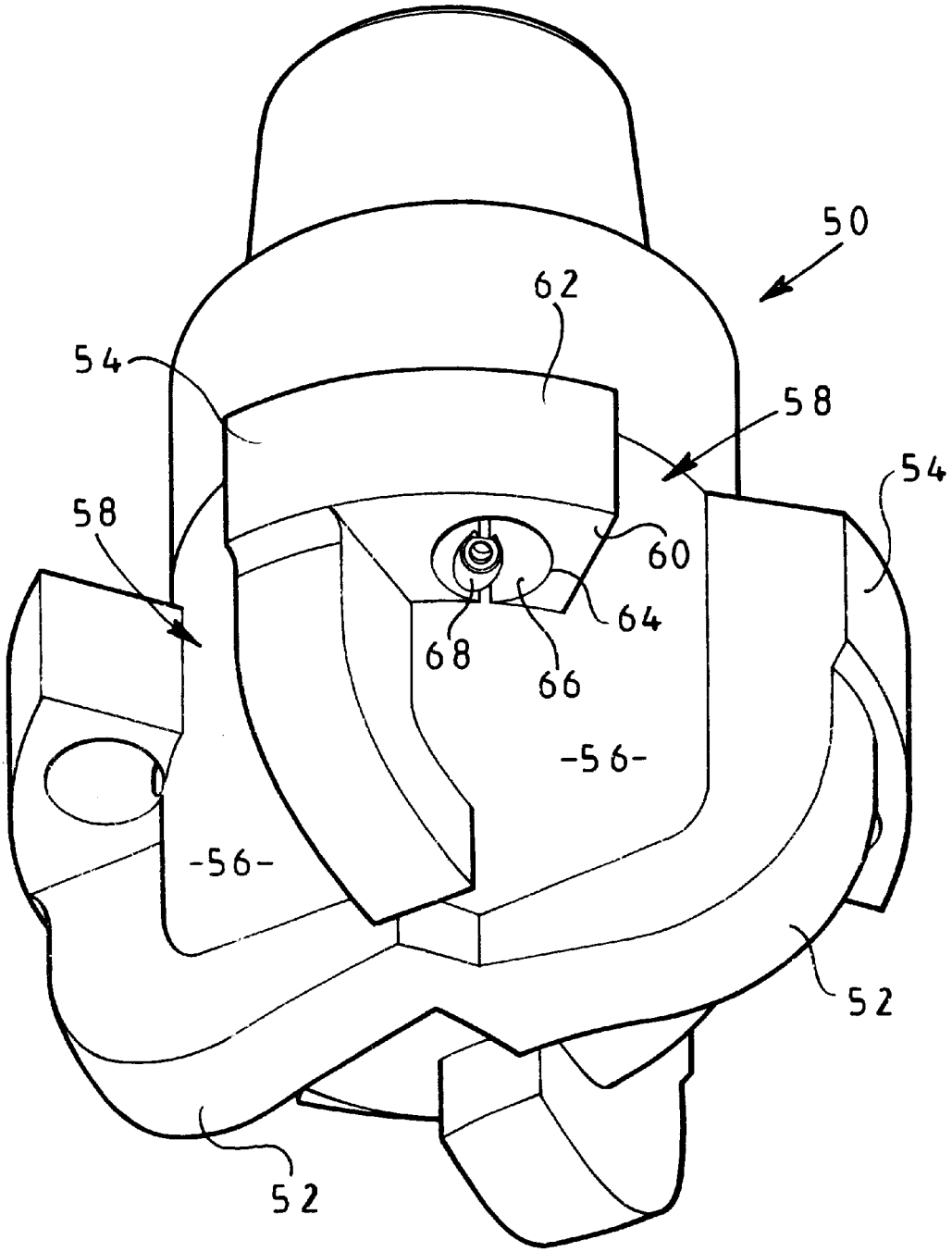
FIG. 3 is a perspective view of an alternative form of drill bit in accordance with the invention.

In the arrangement of FIGS. 1 and 2 only alternate channels are formed at their outer ends with the combination of a junk slot and a bearing surface in accordance with the present invention. This is acceptable since the channels 16 are comparatively narrow. FIG. 3 shows an alternative arrangement where each channel has such a combination at its outer end.

Referring to FIG. 3: the bit body 50 has four generally equally spaced blades 52 at the outer extremities of which are kickers each having a bearing surface 54. For simplicity the cutters mounted along the blades 52 are not shown. Channels 56 are defined between adjacent blades 52 and nozzles (also not shown) deliver fluid to flow outwardly along the channel 56.

Each channel 56 is provided at its outer end with a junk slot 58 which is located on the leading side of one of the adjacent blades 52 and which extends across approximately half of the width of the outer end of the channel 56. There is provided across the rest of the outer end of each channel 56 a wall portion 60 having an outer bearing surface 62 which forms a continuation of the bearing surface 54 on the adjacent kicker. The surface of the wall 60 which faces into the channel 56 is formed with an opening 64 into a passage 66 which passes axially through the wall portion 60 to an opening (not shown) communicating with the annulus between the drill string and the wall of the borehole being drilled. A nozzle 68 is located in a recess 70 in the wall of the passage 66 and is directed towards the opening 64 into the passage. However, arrangements are possible where the nozzle is directed in the opposite direction, towards the outlet from the passage 66.

Whereas the present invention has been described in particular relation to the drawings attached hereto, it should be understood that other and further modifications, apart from those shown or suggested herein, may be made within the scope and spirit of the present invention.

What is claimed:

1. A rotary drill bit for drilling a borehole into the earth comprising a bit body having a leading face and a gauge region, a plurality of cutting elements mounted on the bit body, a plurality of blades formed on the leading face of the bit, a plurality of axially extending kickers formed on the outer extremities of a plurality of said blades providing part-cylindrical bearing surfaces which, in use, bear against a wall of the borehole, a plurality of fluid channels between said blades extending outwardly away from the bit axis across said leading face and towards the gauge region, and a plurality of nozzles for supplying fluid to said channels, there being provided at the outer end of at least one of said channels, in the gauge region, an outwardly facing junk slot which extends across only a part of the width of the channel, and an additional bearing surface adjacent to said kickers which also extends across only a part of the channel and which, in use, also bears against the wall of the borehole, there being provided in said channel, inwardly of the gauge region, an opening into an enclosed passage which passes internally through the bit body to an outlet.

2. A drill bit according to claim 1, wherein the opening into the enclosed passage is located in a part of the channel leading to said additional bearing surface.

3. A drill bit according to claim 2, wherein the opening is located at the outer end of the channel, adjacent the additional bearing surface.

4. A drill bit according to claim 1, wherein the outlet from the enclosed passage communicates, in use, with an annulus between a drill string to which the drill bit is connected and a wall of the borehole being drilled.

5. A drill bit according to claim 1, wherein the additional bearing surface comprises the outer surface of a wall which extends partly across the outer end of the channel, said enclosed passage extending from said opening on one side of the wall to said outlet on the opposite side of the wall.

6. A drill bit according to claim 5, wherein the [internal] enclosed passage extends in generally the same direction as the junk slot.

7. A drill bit according to claim 1, wherein there is provided a single junk slot located at one side of the outer end of the channel, and adjacent a single bearing surface located at the other side of the outer end of the channel.

8. A drill bit according to claim 1, wherein the junk slot is located adjacent the trailing side of the channel with respect to the normal direction of rotation of the drill bit.

9. A drill bit according to claim 1, wherein all of the channels in the leading face of the drill bit have at their respective outer ends the combination of a junk slot and the additional bearing surface.

10. A drill bit according to claim 1, wherein only some of the channels have at their respective outer ends the combination of a junk slot and the additional bearing surface.

11. A drill bit according to claim 10, wherein those channels which are not provided with the combination of a junk slot and the additional bearing surface at the outer end thereof are provided with one of a junk slot or the additional bearing surface which extends across substantially the whole width of the outer end of the channel.

12. A drill bit according to claim 10, wherein at least one of the channels has a bearing surface extending across substantially the whole width of the outer end thereof, and there is provided in said channel, inwardly of the gauge region, an opening into an enclosed passage which passes internally through the bit body to an outlet.

13. A drill bit according to claim 1, wherein the combination of junk slot and additional bearing surface is provided at the outer ends of alternate channels around the circumference of the bit body.

14. A drill bit according to claim 1, wherein said cutting elements are mounted along said blades.

15. A drill bit according to claim 1, wherein there is provided a nozzle in said enclosed passage.

16. A drill bit according to claim 15, wherein the nozzle is directed towards said opening, so as to deliver fluid into the channel in which the opening is formed.

17. A drill bit according to claim 15, wherein the nozzle is directed towards said outlet.

18. A rotary drill bit comprising a bit body having a leading face and a gauge region, a plurality of cutting elements mounted on the bit body, a plurality of fluid channels extending outwardly away from the bit axis across said leading face and towards the gauge region, and a plurality of nozzles for supplying fluid to said channels, there being provided at the outer end of at least one of said channels, in the gauge region, an outwardly facing junk slot which extends across only a part of the width of the channel, and a bearing surface which also extends across only a part of the channel and which, in use, bears against a wall of the borehole being drilled, there being provided in said channel, inwardly of the gauge region, an opening into an enclosed passage which passes internally through the bit body to an outlet wherein only some of the channels have at their respective outer ends the combination of a junk slot and a bearing surface.

19. A drill bit according to claim 18, wherein the opening into the enclosed passage is located in a part of the channel leading to said bearing surface.

20. A drill bit according to claim 19, wherein the opening is located at the outer end of the channel, adjacent the bearing surface.

21. A drill bit according to claim 18, wherein the outlet from the enclosed passage communicates, in use, with an annulus between a drill string to which the drill bit is connected and a wall of the borehole being drilled.

22. A drill bit according to claim 18, wherein the bearing surface comprises the outer surface of a wall which extends partly across the outer end of the channel, said enclosed passage extending from said opening on one side of the wall to said outlet on the opposite side of the wall.

23. A drill bit according to claim 22, wherein the enclosed passage extends in generally the same direction as the junk slot.

24. A drill bit according to claim 18, wherein there is provided a nozzle in said enclosed passage.

25. A drill bit according to claim 24, wherein the nozzle is directed towards said opening, so as to deliver fluid into the channel in which the opening is formed.

26. A drill bit according to claim 24, wherein the nozzle is directed towards said outlet.

27. A rotary drill bit comprising a bit body having a leading face and a gauge region, a plurality of cutting elements mounted on the bit body, a plurality of fluid channels extending outwardly away from the bit axis across said leading face and towards the gauge region, and a plurality of nozzles for supplying fluid to said channels, there being provided at the outer end of at least one of said channels, in the gauge region, an outwardly facing junk slot which extends across only a part of the width of the channel, and a bearing surface which also extends across only a part of the channel and which, in use, bears against a wall of the borehole being drilled, there being provided in said channel, inwardly of the gauge region, an opening into an enclosed passage which passes internally through the bit body to an outlet wherein the combination of junk slot and bearing surface is provided at the outer ends of alternate channels around the circumference of the bit body.

* * * * *